US007037387B2

(12) United States Patent
Nagao et al.

(10) Patent No.: US 7,037,387 B2
(45) Date of Patent: May 2, 2006

(54) STEEL WIRE EXCELLENT IN DESCALABILITY IN MECHANICAL DESCALING AND METHOD FOR PRODUCTION THEREOF

(75) Inventors: Mamoru Nagao, Hyogo (JP); Takuya Kochi, Hyogo (JP); Masahiro Nomura, Hyogo (JP); Hiroshi Yaguchi, Hyogo (JP); Takaaki Minamida, Hyogo (JP); Noriaki Hiraga, Hyogo (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 107 days.

(21) Appl. No.: 10/473,131

(22) PCT Filed: Feb. 5, 2003

(86) PCT No.: PCT/JP03/01148

§ 371 (c)(1),
(2), (4) Date: Oct. 6, 2003

(87) PCT Pub. No.: WO03/066923

PCT Pub. Date: Aug. 14, 2003

(65) Prior Publication Data

US 2004/0129354 A1 Jul. 8, 2004

(30) Foreign Application Priority Data

Feb. 6, 2002 (JP) ..... 2002-029156

(51) Int. Cl.
*C22C 38/02* (2006.01)
*C21D 8/06* (2006.01)

(52) U.S. Cl. ..... 148/320; 148/595; 148/598; 148/599; 148/602; 428/606

(58) Field of Classification Search ..... 148/320, 148/595–600, 602; 428/606
See application file for complete search history.

(56) References Cited

U.S. PATENT DOCUMENTS 4,375,378 A * 3/1983 Ohtani et al. ..... 148/596
4,648,914 A 3/1987 Stanescu et al.
5,658,402 A * 8/1997 Kawana et al. ..... 148/595
5,776,267 A 7/1998 Nanba et al.

(Continued)

FOREIGN PATENT DOCUMENTS

EP 0 493 807 A1 7/1992

(Continued)

OTHER PUBLICATIONS

U.S. Appl. No. 10/473,131, filed Oct. 6, 2003, Nagao et al.

(Continued)

*Primary Examiner*—Deborah Yee
(74) *Attorney, Agent, or Firm*—Oblon, Spivak, McClelland, Maier & Neustadt, P.C.

(57) ABSTRACT

The present invention provides a steel wire rod excellent in scale peelability for mechanical descaling, and a manufacturing method thereof.

The steel wire rod in accordance with the present invention has: a base metal portion formed of a steel containing C in an amount of not more than 1.1% and Si in an amount of 0.05 to 0.80% on a mass % basis as components; and a scale layer deposited on the surface of the base metal portion, wherein the Si average concentration in the interface portion of the scale with the base metal portion is not less than 2.0 times the Si content of the base metal portion.

10 Claims, 1 Drawing Sheet

U.S. PATENT DOCUMENTS

| | | | | |
|---|---|---|---|---|
| 6,264,759 | B1 * | 7/2001 | Bae et al. | 148/320 |
| 6,322,641 | B1 | 11/2001 | Makii et al. | |
| 6,645,319 | B1 | 11/2003 | Nagao et al. | |
| 6,783,609 | B1 | 8/2004 | Hata et al. | |
| 6,800,147 | B1 | 10/2004 | Nagao et al. | |
| 2004/0129354 | A1 | 7/2004 | Nagao et al. | |

FOREIGN PATENT DOCUMENTS

| | | |
|---|---|---|
| EP | 0 693 570 A1 | 1/1996 |
| JP | 7-204726 | 8/1995 |
| JP | 8-295991 | 11/1996 |
| JP | 8-295992 | 11/1996 |
| JP | 8-295993 | 11/1996 |
| JP | 10-008203 | 1/1998 |
| JP | 10-147844 | 6/1998 |
| JP | 10-204582 | 8/1998 |
| JP | 11-172332 | 6/1999 |

OTHER PUBLICATIONS

U.S. Appl. No. 11/022,792, filed Dec. 28, 2004, Nagao.
U.S. Appl. No. 10/528,263, filed Mar. 17, 2005, Nagao et al.

* cited by examiner

STEEL WIRE EXCELLENT IN DESCALABILITY IN MECHANICAL DESCALING AND METHOD FOR PRODUCTION THEREOF

TECHNICAL FIELD

The present invention relates to the overall aspects of a steel wire rod requiring descaling. It relates to a steel wire rod serving as, for example, a wire rod for cold drawing, a wire rod for welding wire, or a material for a steel wire to be used for a wire rope, a rubber hose, a tire cord, or the like, and a manufacturing method thereof.

BACKGROUND ART

A steel wire is generally manufactured through a step of wire drawing a steel wire rod manufactured by hot rolling to a required wire diameter. In the wire drawing, it is necessary to sufficiently remove the scale deposited on the surface of the wire rod at the stage prior to processing in order to ensure favorable drawability.

The removal of such a scale has been mainly accomplished by acid pickling in the prior art. However, the acid pickling may unfavorably deteriorate the working environment, and further entails the disposal of liquid wastes after use. For these reasons, "mechanical descaling" (mechanical scale removal) for mechanically removing the scale has become performed in place of the acid pickling step.

The mechanical descaling is carried out not only through the process based on shot blast or air blasting, but also through the process in which the scale is peeled off by bending or twisting. On the other hand, if the scale is peeled off during transfer of a wire rod, the base metal is exposed, so that rust may form. Accordingly, there is a demand for the formation of such a scale as to be less likely to be peeled off during transfer, and more likely to be peeled off upon mechanical descaling for a steel wire rod after hot rolling.

In response to such a demand, as described in, for example, Japanese Laid-Open Patent Publication Nos. Hei 7-204726, 8-295992, 10-204582, and 11-172332, the following methods are adopted: the composition of the scale is controlled; the interface roughness between the base metal portion and the scale is controlled; and the thickness of the scale is controlled; and other methods.

However, in these prior arts, there is no philosophy that the Si concentration in the scale is controlled for enhancing the mechanical descalability. In addition, although the Si concentration in the scale depends upon the cooling rate after hot rolling in wire rod manufacturing, no close study has been made on the cooling conditions. As a result, although the methods pertain to a steel wire rod which has a scale with an appropriate peelability on the surface, they do not produce sufficient effects.

DISCLOSURE OF THE INVENTION

As described above, for a steel wire rod to be subjected to wire drawing, various methods are adopted for improving the mechanical descalability. However, in recent years, there has been an increasingly growing demand for the improvement of the descalability, so that a further countermeasure is demanded.

In view of the foregoing problem, the present invention has been completed. It is therefore an object of the present invention to provide a steel wire rod excellent in scale peelability for mechanical descaling (mechanical descalability), and a manufacturing method thereof.

The present inventors have conducted a close study on a steel wire rod having an excellent mechanical descalability (hereinafter, may be abbreviated as a "MD property") regardless of the thickness of the scale. As a result, they have found that the peelability of the scale largely depends upon the concentration of Si in the scale layer interface portion in contact with the interface with the base metal portion of the steel wire rod. Inconsequence, they have completed the present invention.

Namely, a steel wire rod of the present invention has: a base metal portion comprising a steel containing C in an amount of not more than 1.1 mass % and Si in an amount of 0.05 to 0.80 mass %; and a scale layer deposited on the surface of the base metal portion, characterized in that the Si average concentration in the interface portion of the scale with the base metal portion is not less than 2.0 times the Si content of the base metal portion. The steel wire rod of the present invention satisfies the requirements, thereby to be remarkably improved in mechanical descalability.

The "Si concentrated area" in which the Si concentration is not less than 2.0 times the Si content of the base metal portion in the interface portion of the scale layer preferably occupies not less than 60 area %. This is because more favorable scale peelability can be obtained thereby.

The Si content of the base metal portion is preferably not less than 0.1 mass % and not more than 0.6 mass %. This is for achieving more proper Si average concentration in the interface portion of the scale, and implementing further improvement of the mechanical descalability.

Further, the base metal portion preferably comprises C in an amount of not more than 1.1 mass %, Si in an amount of 0.05 to 0.80 mass %, and the balance being Fe and inevitable impurities. This is intended for the following purpose. By strictly defining the composition of the base metal portion, the steel wire rod is allowed to exhibit stable mechanical descalability.

The base metal portion may further comprises, other than the foregoing components, not less than one selected from the group consisting of Mn: 0.01 to 2.0 mass %, Cr: 0 to 2.0 mass %, Mo: 0 to 0.6 mass %, Cu: 0 to 2.0 mass %, Ni: 0 to 4.0 mass %, Ti: 0 to 0.1 mass %, Al: 0.001 to 0.10 mass %, N: 0 to 0.03 mass %, V: 0 to 0.40 mass %, Nb: 0 to 0.15 mass %, and B: 0 to 0.005 mass %. This is because addition of common ingredients of a steel wire rod cannot be considered to adversely affect the mechanical descalability of the steel wire rod of the present invention.

Also for the steel wire rod of which the foregoing composition is strictly defined, the Si concentrated are in the interface portion of the scale layer preferably occupies not less than 60 area %, and the Si content of the base metal portion is preferably not less than 0.1 mass % and not more than 0.6 mass %.

Further, the steel wire rod of the present invention is characterized by being manufactured by:

hot rolling a steel containing C: not more than 1.1 mass % and Si: 0.05 to 0.80 mass % at a rolling ending temperature of 1000 to 1100° C.;

after completion of the hot rolling step, cooling the steel down to a coiling starting temperature of 950 to 800° C. at a first cooling rate of less than 50° C./s;

cooling the steel in an oxygen supply atmosphere from the coiling starting temperature to 700° C. at a second cooling rate of not less than 3° C./s and not more than the critical cooling rate defined by the following equation (1):

$$\text{Critical cooling rate } (^\circ\text{ C./}s) = 22 + 11 \times [\text{Si}] - 8.5 \times \log(D) \quad (1)$$

(where [Si] denotes the Si content (mass %) of the steel, and D denotes the wire diameter (mm).); and further cooling the steel from 700 to 500° C. at a third cooling rate of not more than 2.5° C./s. The steel wire rod manufactured by undergoing the steps exhibits the feature that "the Si average concentration in the interface portion of the scale is not less than 2.0 times the Si content of the base metal portion", and other features, and has excellent mechanical descalability.

The first cooling rate is preferably not more than 45° C./s. This is for still further accelerating the Si concentration in the interface portion of the scale, and ensuring favorable mechanical descalability.

A method for manufacturing the steel wire rod in accordance with the present invention is characterized by including:

a step of hot rolling a steel containing C: not more than 1.1 mass % and Si: 0.05 to 0.80 mass % at a rolling ending temperature of 1000 to 1100° C.;

a step of, after completion of the hot rolling step, cooling the steel down to a coiling starting temperature of 950 to 800° C. at a first cooling rate of less than 50° C./s;

a step of cooling the steel in an oxygen supply atmosphere from the coiling starting temperature to 700° C. at a second cooling rate of not less than 3° C./s and not more than the critical cooling rate defined by the following equation (1):

$$\text{Critical cooling rate } (^\circ\text{ C./}s) = 22 + 11 \times [\text{Si}] - 8.5 \times \log(D) \quad (1)$$

(where [Si] denotes the Si content (mass %) of the steel, and D denotes the wire diameter (mm).); and a step of further cooling the steel from 700 to 500° C. at a third cooling rate of not more than 2.5° C./s. The steel wire rod manufactured by the manufacturing method exhibits the feature that "the Si average concentration in the interface portion of the scale is not less than 2.0 times the Si content of the base metal portion", and other features, and has excellent mechanical descalability.

Further, the first cooling rate is preferably not more than 45° C./s. This is for ensuring more excellent mechanical descalability.

BEST MODE FOR CARRYING OUT THE INVENTION

Figure 1:
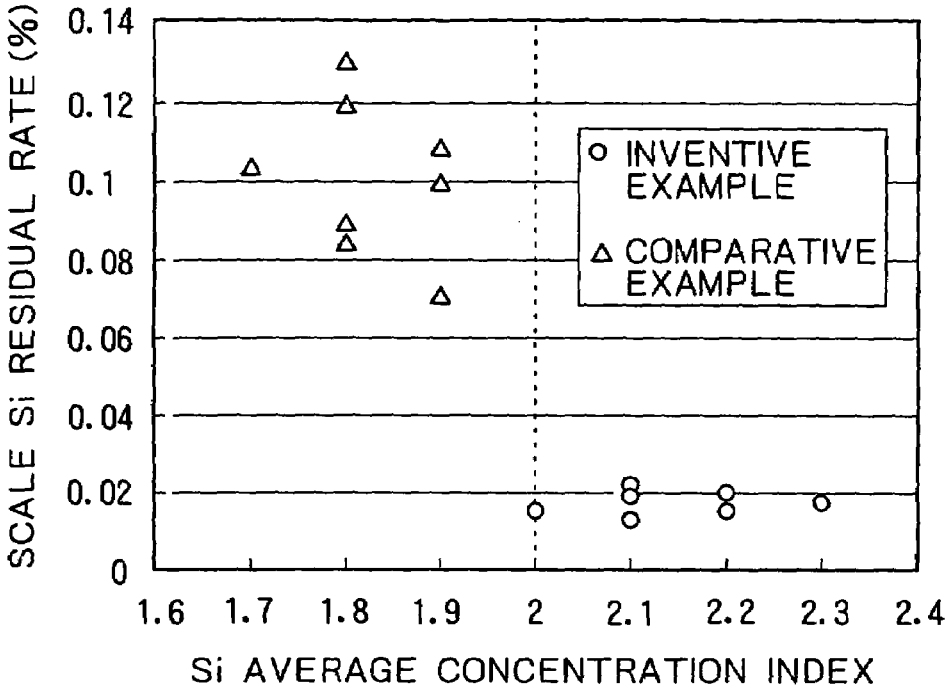
FIG. 1 is a graph showing the relationship between the Si average concentration index and the scale residual rate in Example A described later.

The largest feature that a steel wire rod of the present invention has lies in that the MD property has been remarkably improved by defining the Si concentration in the surface of a scale layer on the base metal side.

Namely, there has been present a technology for improving the MD property also in the prior art. However, there is no example in which attention is given to the Si concentration in the scale, and the effects have not been sufficient. However, the present inventors have found as follows: it is possible to remarkably improve the MD property if the Si concentration is controlled; and it is possible to carry out the Si concentration control with ease and reliability by appropriately adjusting the steel composition and the hot rolling conditions, and the subsequent cooling conditions. In consequence, they have completed the present invention.

Hereinafter, a description will be given to the embodiments of the present invention exhibiting such a feature, and the effects thereof.

First, the reason for restricting each chemical component (below, expressed in unit of "mass %", unless otherwise specified) of the base metal portion (the steel portion to be coated with a scale) of a steel wire rod of the present invention will be described.

C: not more than 1.1% (excluding 0%)

"C" is a main element for determining the mechanical properties of a steel. It is possible to appropriately set the C content according to the intended purpose. However, if the C content is excessive, the hot workability during manufacturing of a wire rod is deteriorated. Therefore, the upper limit is set at 1.1% in consideration of the hot workability.

Si: 0.05 to 0.80%

"Si" is an essential element for raising the Si concentration in the scale layer in the vicinity of the interface with the base metal portion. If the content is less than 0.05%, the amount of Si to be incorporated into the scale layer interface portion becomes too small. On the other hand, excessive addition thereof results in the formation of a surface decarburized layer, or conversely results in the deterioration in MD property. For this reason, the lower limit is set at 0.05%, and preferably 0.1% and the upper limit is set at 1.0%, preferably 0.80%, and more preferably 0.6%.

The balance includes Fe and inevitable impurities. Other than this, there is no particular restriction on the components other than C and Si, so that appropriate other components may be contained according to the required characteristics such as strength and corrosion resistance. For example, there may be contained therein not less than one selected from the group consisting of: Mn: 0.01 to 2.0%, Cr: 0 to 2.0%, Mo: 0 to 0.6%, Cu: 0 to 2.0%, Ni: 0 to 4.0%, Ti: 0 to 0.1%, Al: 0.001 to 0.10%, N: 0 to 0.03%, V: 0 to 0.40%, Nb: 0 to 0.15%, and B: 0 to 0.005%.

The scale layer is formed on the surface of the steel wire rod after hot rolling. In order to remarkably improve the MD property, particularly, the Si concentration in the scale interface portion formed adjacent to the interface with the base metal portion is important. The Si concentration in the scale layer interface portion largely affects the characteristics of the interface between the scale layer and the base metal portion, and controls the peelability of the whole scale layer. Incidentally, the Si in the interface portion is present mostly in oxide form such as $SiO_2$.

The Si in the scale is supplied from the base metal portion upon scale formation, and hence segregates in the interface portion. In other words, the term "Si concentration" in the scale layer interface portion denotes the Si concentration in the scale concentrated toward the side in contact with the base metal portion (local Si amount). Therefore, it is possible to determine the "Si concentration in the scale layer interface portion" based on the data obtainable from the surface of the scale on the interface side.

For example, the measurement of the Si concentration in the interface portion of the scale layer can be carried out in the following manner. The base metal portion of the steel wire rod is molten to collect the scale crust composed of the scale layer which covered the surface of the base metal portion. Then, the inner surface of the scale crust is subjected to line analysis by means of an EPMA (Electron Probe Micro Analyzer). EPMA is capable of analysis of the composition of the sample surface, and hence suitable for the present invention, in accordance with which the Si concentration in the scale interface portion where Si segregates is defined. The specific measuring method will be explained in examples described later. Whereas, as a dissolving solution for dissolving the base metal portion in the measuring method, for example, a bromine-sodium bromide-sodium dodecylbenzene sulfonate (SDBS)-methanol solution can be used (see, Current Advances in Materials and Processes—The Iron and Steel Institute of Japan, vol. 13, p1084 (2000)).

By allowing Si in the interface portion of the scale layer to be properly present, the scale layer increases in breaking strength upon causing a given or more distortion in the steel wire rod having the scale layer deposited thereon, so that the scale chip size to be broken by mechanical descaling increases. As a result, it is possible to obtain a scale layer having favorable peelability, so that it is possible to produce excellent peeling effect by mechanical descaling such as a bending process or a twisting process. At this step, as apparent from the examples described later, Si is given from the base metal portion so that the Si average concentration in the interface portion is not less than 2.0 times the Si content of the base metal steel composition. As a result, it is possible to obtain favorable peelability. Whereas, if the Si average concentration is less than 2.0 times, a remarkable effect cannot be observed.

Herein, the term "the Si content of the base metal portion (expressed in unit of "mass %" in the present invention)" denotes the first Si content of the steel (the Si content prior to the formation of the scale layer). This is for the following reason. The Si in the scale layer migrates from the base metal portion, and hence, theoretically, the Si content of the base metal portion after the scale layer formation should decrease. However, since the scale layer is sufficiently thinner than the base metal portion, the amount of the Si decreased is negligible.

Whereas, by forming the scale layer so that the "Si concentrated area" (denoting the portion having a Si concentration of not less than 2.0 times relative to the Si content of the base metal portion steel composition) accounts for not less than 60%, and more preferably not less than 80% in areal proportion, it is possible to obtain more favorable scale peelability.

Then, a description will be given to a manufacturing method suitable for the industrial production of the steel wire rod of the present invention.

For obtaining the foregoing scale structure, a steel piece containing C in an amount of not more than 1.1 mass % and Si in an amount of 0.05 to 0.80 mass % is heated according to an ordinary method. (1) The steel piece is hot rolled at an ending temperature of 1000 to 1100° C. Then, (2) the hot rolled wire rod is cooled down to a coiling starting temperature of 800 to 950° C. at a first cooling rate of less than 50° C./s, and coiled. Subsequently, (3) the coiled wire rod is cooled down to the wire rod surface temperature of 700° C. in an oxygen supply atmosphere (an atmosphere capable of supplying an oxygen), for example, in an air, at a second cooling rate of not less than 3° C./s and not more than the critical cooling rate defined by the following equation (1):

$$\text{Critical cooling rate of second cooling rate (° C./s)} = 22+11\times[\text{Si}]-8.5\times\log(D) \quad (1)$$

(where [Si] denotes the Si content (mass %) of the steel, and D denotes the wire diameter (mm).)

Further, (4) Cooling is carried out from 700 to 500° C. at a third cooling rate of not more than 2.5° C./s. The cooling down to 500° C. or lower has no particular restriction, and either slow cooling or quenching may be adopted. Thereafter, in general, the cooled rod is used a "wire rod" as it is, and subjected to a wire drawing processing. Alternatively, prior thereto, it may also be subjected to another thermal processing, or the like.

Below, the respective manufacturing conditions will be described in details.

A scale forms and grows after the completion of hot rolling, and Si is supplied from the base metal portion of a wire rod into the scale, and concentrated mainly in the interface portion of the scale layer. At this step, if the ending temperature of hot rolling is less than 1000° C., the concentration of Si into the scale after the start of cooling is retarded. As a result, it is not possible to obtain a desired Si concentrated scale. On the other hand, if rolling is completed at more than 1100° C., the Si concentration into the scale is accelerated. However, the Si concentration in the scale becomes uneven, so that there occur portions from which the scales will not be peeled off by mechanical descaling. For this reason, the hot rolling ending temperature is set at 1000 to 1100° C.

The first cooling rate after completion of rolling, i.e., the cooling rate from the hot rolling ending temperature to the coiling starting temperature of 950 to 800° C. is required to be set at less than 50° C./s. If it is not less than 50° C./s, it becomes difficult to ensure the time margin for the nucleus formation and growth of the scale. Even if the subsequent cooling conditions are controlled, the Si concentration becomes insufficient. The cooling rate is desirably set at not less than 30° C./s, and more preferably not less than 35° C./s in consideration of the productivity. Further, in order that the proportion of the Si concentrated area in the interface portion of the scale layer is not less than 60% to ensure a scale structure with more favorable peelability, the cooling rate is preferably set at not more than 45° C./s.

The coiling starting temperature is set at 950 to 800° C. in the present invention because it also controls the initial growth of the scale nucleus formation as with the definition for the first cooling rate. If coiling is carried out from at more than 950° C., uneven concentration of Si in the scale occurs, resulting in deterioration of the scale peelability. Whereas, with coiling from a temperature lower than 800° C., the Si concentration in the scale becomes insufficient, also resulting in a deterioration of the scale peelability.

In order to accelerate the Si concentration into the scale after coiling for obtaining a prescribed Si concentration in the interface portion, the second cooling rate from the coiling starting temperature to 700° C. is required to be controlled in accordance with the rolled wire diameter and the Si content of the base metal portion. Specifically, it is set at not less than 3° C./s and not more than the critical cooling rate of the equation (1). If the cooling rate from immediately after the start of coiling down to 700° C. is set at less than 3° C./s, the scale layer increases in thickness more than necessary. Accordingly, although the scale peelability becomes very favorable, the scale is peeled off prior to coming to the mechanical descaling step. As a result, rust becomes likely to form at the peeled portion during storage or transfer of the wire rod coil. On the other hand, if the second cooling rate exceeds the critical cooling rate defined according to the equation (1), the amount of Si concentrated in the scale becomes insufficient. As a result, it becomes impossible to obtain a desired scale peelability. It is noted that the critical cooling rate is the one determined from the data of examples described later.

Further, the third cooling rate from 700° C. to 500° C. is also important. By adopting a cooling rate of not more than 2.5° C./s therefor, it becomes possible to accelerate the Si concentration. As a result, it is possible to obtain a scale having a desired favorable peelability.

Hereinafter, the present invention will be described specifically by way of examples, which should not be construed as limiting the scope of the invention.

EXAMPLE A

Carbon steels having their respective C contents and Si contents described in Table 1 were produced in a converter. Each resulting steel ingot was broken and rolled to produce a billet (155 mm square). The billet was heated to about 1150° C., followed by hot rolling. The rolling was completed at 1030° C., resulting in wire rods having various diameters D (mm) as shown in the same table. Subsequently after completion of rolling, each resulting wire rod was cooled down to the coiling starting temperature of 840° C. at a first cooling rate of 40° C./s. Then, coiling was started, and cooling was carried out down to 700° C. at various second cooling rates. Further, cooling was carried out at the third cooling rate of 2.5° C./s between 700 and 500° C.

The average concentration of Si in the interface portion of the scale layer deposited on each resulting wire rod was measured. The measurement was carried out as described previously in the following manner. Namely, the base metal portion of the wire rod was dissolved by the dissolving solution, so that the scale crust composed of the scale layer was separated therefrom. Then, the inner surface (the surface on the side of the interface with the base metal portion) of the scale crust was subjected to EPMA line analysis. The direction of measurement line was set along the circumference. The measuring conditions were as follows: the accelerating voltage was set at 15 kV; and the emission current, $1\times10^{-8}$ A. Thus, 400 points were measured at a measuring spacing of 100 nm between the scanning distance of 40 μm, and the Si average concentration of the 400 measuring points was determined as the Si average concentration in the interface portion of the scale layer. It is noted that (Si average concentration in the scale layer interface portion)/(Si content of the steel of the base metal portion) is referred to as the Si average concentration index.

The wire rods were used to be examined for each mechanical descalability thereof. Each wire rod was cut to a length of 250 mm. Then, the cut piece was mounted in a crosshead with the distance between chucks set at 200 mm, and applied with a tensile distortion of 4%. Then, the piece was taken out from the chucks. Compressed air was blown against the test piece to blow off the scale on the wire rod surface, and the wire rod was cut into a 200 mm long piece, and the resulting cut piece was determined for the weight (w1). Then, it was immersed in a hydrochloric acid to completely remove the scale deposited on the wire rod surface, and determined for the weight (w2) again. The residual scale rate was determined from these measured values according to the following equation. The measured values are shown together in Table 1. It is noted that like-numbered inventive example and comparative example have like steel components.

$$\text{Residual scale rate (\%)}=(w1-w2)/w2\times100$$

TABLE 1

| Sample | C content (%) | Si content (%) | Wire rod diameter D (mm) | Second cooling rate limit (° C./s) | Second cooling rate (° C./s) | Interface portion Si average concentration (%) | Si average concentration index | Scale residual rate (%) |
|---|---|---|---|---|---|---|---|---|
| Inventive Example 1 | 0.08 | 0.11 | 5.5 | 17 | 16 | 0.23 | 2.1 | 0.0210 |
| Inventive Example 2 | 0.46 | 0.02 | 8.0 | 15 | 14 | 0.04 | 2.2 | 0.0190 |
| Inventive Example 3 | 0.57 | 0.15 | 12.0 | 14 | 13 | 0.30 | 2.0 | 0.0160 |
| Inventive Example 4 | 0.72 | 0.20 | 5.5 | 18 | 17 | 0.42 | 2.7 | 0.0220 |
| Inventive Example 5 | 0.77 | 0.24 | 5.0 | 19 | 18 | 0.53 | 2.2 | 0.0150 |
| Inventive Example 6 | 0.83 | 0.19 | 6.4 | 17 | 15 | 0.40 | 2.1 | 0.0130 |
| Inventive Example 7 | 0.89 | 0.20 | 5.5 | 18 | 17 | 0.46 | 2.3 | 0.0170 |
| Inventive Example 8 | 1.10 | 0.25 | 5.5 | 18 | 17 | 0.50 | 2.0 | 0.0150 |
| Inventive Example 9 | 0.90 | 0.15 | 5.5 | 17 | 17 | 0.33 | 2.2 | 0.0200 |
| Inventive Example 10 | 0.15 | 0.78 | 5.5 | 24 | 23 | 1.64 | 2.1 | 0.0190 |
| Comparative Example 1 | 0.08 | 0.11 | 5.5 | 17 | 18 | 0.21 | 1.9 | 0.0716 |
| Comparative Example 2 | 0.46 | 0.02 | 8.0 | 15 | 16 | 0.04 | 1.8 | 0.0900 |
| Comparative Example 3 | 0.57 | 0.15 | 12.0 | 14 | 15 | 0.29 | 1.9 | 0.1000 |
| Comparative Example 4 | 0.72 | 0.20 | 5.5 | 18 | 19 | 0.38 | 1.9 | 0.1100 |
| Comparative Example 5 | 0.77 | 0.24 | 5.0 | 19 | 20 | 0.43 | 1.8 | 0.1200 |
| Comparative Example 6 | 0.83 | 0.19 | 6.4 | 17 | 18 | 0.34 | 1.8 | 0.1300 |
| Comparative Example 7 | 0.89 | 0.20 | 5.5 | 18 | 19 | 0.38 | 1.9 | 0.1000 |
| Comparative Example 8 | 1.10 | 0.25 | 5.5 | 18 | 20 | 0.42 | 1.7 | 0.1040 |
| Comparative Example 9 | 0.90 | 0.15 | 5.5 | 17 | 18 | 0.27 | 1.8 | 0.0850 |
| Comparative Example 10 | 0.15 | 0.78 | 5.5 | 24 | 25 | 1.48 | 1.9 | 0.1090 |

FIG. 1 shows a graph systematically plotting the relationship between the Si concentration index and the residual scale rate based on Table 1. FIG. 1 indicates that the inventive examples and the comparative examples are clearly different from each other in level of the residual scale rate at a Si concentration index of 2.0, and that favorable scale peelability can be obtained at not less than 2.0.

Figure 2:
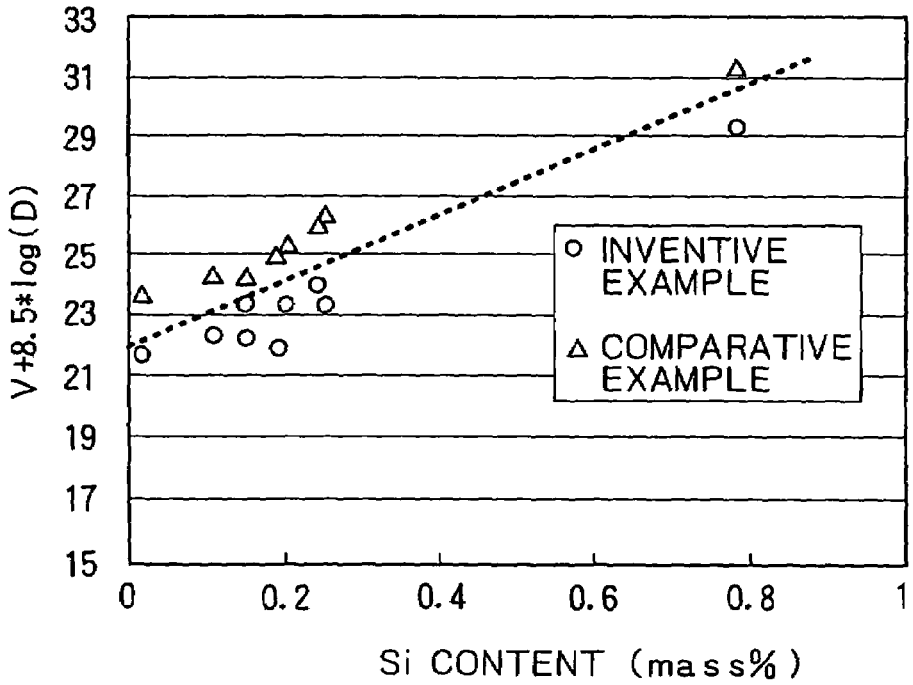
FIG. 2 is a graph showing the relationship between the base metal portion Si content (mass %), and the second cooling rate V (° C./s) and the wire diameter D (mm) in Example A described later.

On the other hand, in order to examine the limit (upper limit) of the second cooling rate V (° C./s) from the start of coiling to 700° C., which required for obtaining a wire rod capable of proving favorable scale peelability, a graph systematically plotting the relationship between [Si] in the base metal portion and (V+8.5*log (D)) for each sample of the inventive examples and the comparative examples is shown in FIG. 2. The [Si] is expressed in unit of mass %, and the D is expressed in unit of mm.

FIG. 2 indicates that the inventive examples and the comparative examples are divided from each other into two parts with the straight line in the drawing as boundary. The straight line is expressed by the following equation (1). Incidentally, in Table 1, the limit (upper limit) value of the second cooling rate calculated according to the equation (1) is also shown together.

$$V+8.5*\log(D)=11\times[\mathrm{Si}]+22 \quad (1)$$

Each resulting wire rod was determined for the Si average concentration in the interface portion of the scale layer, the Si average concentration index, and the scale residual rate in the same manner as in Example A. Further, the areal proportion of the measuring points in which (measuring point Si concentration by line analysis)/(base metal portion Si content) was not less than 2.0 based on the Si content of steel of the base metal portion was determined as the areal proportion (%) of the Si concentrated area in the interface portion of the scale layer. These results are shown together in Table 2.

TABLE 2

| Sample | C content (%) | Si content (%) | Wire rod diameter D (mm) | Rolling ending temperature (° C./s) | First cooling rate (° C./s) | Coiling starting temperature (° C.) | Second cooling rate limit (° C./s) | Second cooling rate (° C./s) | Third cooling rate (° C./s) | Interface portion Si average concentration (%) | Areal proportion of Si concentrated area (%) | Si average concentration index | Scale residual rate (%) |
|---|---|---|---|---|---|---|---|---|---|---|---|---|---|
| Inventive Example 1 | 0.08 | 0.11 | 5.5 | 1020 | 48 | 800 | 17 | 11 | 1.2 | 0.26 | 59 | 2.4 | 0.0210 |
| Inventive Example 2 | 0.46 | 0.02 | 8.0 | 1060 | 48 | 880 | 15 | 12 | 2.3 | 0.06 | 57 | 2.8 | 0.0262 |
| Inventive Example 3 | 0.57 | 0.15 | 12.0 | 1090 | 48 | 800 | 14 | 10 | 2.2 | 0.33 | 57 | 2.2 | 0.0382 |
| Inventive Example 4 | 0.72 | 0.20 | 5.5 | 1100 | 48 | 860 | 18 | 13 | 2.5 | 0.46 | 56 | 2.3 | 0.0311 |
| Inventive Example 5 | 0.77 | 0.24 | 5.0 | 1100 | 48 | 820 | 19 | 15 | 2.1 | 0.96 | 54 | 4.0 | 0.0307 |
| Inventive Example 6 | 0.83 | 0.19 | 6.4 | 1050 | 40 | 910 | 17 | 10 | 2.4 | 0.70 | 82 | 3.7 | 0.0090 |
| Inventive Example 7 | 0.89 | 0.20 | 5.5 | 1100 | 40 | 890 | 18 | 8 | 2.5 | 0.66 | 78 | 3.3 | 0.0143 |
| Inventive Example 8 | 1.10 | 0.25 | 5.5 | 1080 | 40 | 950 | 18 | 10 | 0.8 | 0.90 | 80 | 3.6 | 0.0120 |
| Inventive Example 9 | 0.90 | 0.15 | 5.5 | 1000 | 40 | 900 | 17 | 11 | 0.8 | 0.47 | 94 | 3.1 | 0.0080 |
| Inventive Example 10 | 0.15 | 0.78 | 5.5 | 1000 | 40 | 900 | 24 | 12 | 2.1 | 2.03 | 88 | 2.6 | 0.0132 |
| Comparative Example 1 | 0.08 | 0.11 | 5.5 | 950 | 48 | 850 | 17 | 18 | 1.2 | 0.19 | 45 | 1.7 | 0.0947 |
| Comparative Example 2 | 0.46 | 0.02 | 8.0 | 1120 | 48 | 850 | 15 | 16 | 2.3 | 0.04 | 41 | 1.8 | 0.0900 |
| Comparative Example 3 | 0.57 | 0.15 | 12.0 | 1050 | 48 | 960 | 14 | 15 | 2.2 | — | — | — | — |
| Comparative Example 4 | 0.72 | 0.20 | 5.5 | 1050 | 48 | 780 | 18 | 19 | 2.5 | 0.28 | 36 | 1.4 | 0.1100 |
| Comparative Example 5 | 0.77 | 0.24 | 5.0 | 1050 | 48 | 910 | 19 | 22 | 2.1 | 0.19 | 33 | 0.8 | 0.1200 |
| Comparative Example 6 | 0.83 | 0.19 | 6.4 | 1050 | 40 | 900 | 17 | 18 | 2.4 | 0.17 | 31 | 0.9 | 0.1300 |
| Comparative Example 7 | 0.89 | 0.20 | 5.5 | 1020 | 40 | 930 | 18 | 2 | 2.5 | — | — | — | — |
| Comparative Example 8 | 1.10 | 0.25 | 5.5 | 1020 | 40 | 900 | 18 | 20 | 3.2 | 0.18 | 44 | 0.7 | 0.1040 |
| Comparative Example 9 | 0.90 | 0.15 | 5.5 | 1000 | 40 | 900 | 17 | 18 | 3.6 | 0.14 | 29 | 0.9 | 0.0850 |
| Comparative Example 10 | 0.15 | 0.78 | 5.5 | 1000 | 55 | 900 | 24 | 25 | 2.1 | 1.01 | 30 | 1.3 | 0.1090 |

EXAMPLE B

As with Example A, steels having various C contents and Si contents were used to be subjected to hot rolling, thereby manufacturing wire rods in each of which a scale layer was formed on the base metal portion. The hot rolling ending temperatures and cooling conditions after hot rolling are shown together in Table 2.

Table 2 indicates as follows. For each comparative example, the scale residual rate is about 0.1%. However, for each inventive example in which the Si average concentration index is not less than 2.0, the scale residual rate is not more than about 0.03%, indicating that the scale is remarkably prevented from remaining, and that the sample of the inventive example is a wire rod having a scale layer excellent in scale peelability formed thereon. Particularly, for the sample in which the Si concentrated area occupies not less than 60%, the scale peelability is still more favorable.

INDUSTRIAL APPLICABILITY

In accordance with the present invention, the Si concentration in the interface portion of the scale layer of a steel wire rod is increased to be not less than 2.0 times relative to the Si content of the base metal portion thereof. Therefore, it is possible to provide a steel wire rod having favorable scale peelability not depending upon the scale thickness and the scale composition, from which the scale layer will be peeled off almost without leaving the residue in a mechanical descaling step, while having a proper scale adhesion prior to the mechanical descaling step. Further, in accordance with a manufacturing method of the present invention, it is possible to manufacture the steel wire rod on an industrial scale with ease.

The invention claimed is:

1. A steel wire rod excellent in mechanical descalability, comprising: a base metal portion comprising a steel containing C in an amount of not more than 1.1 mass % and Si in an amount of 0.05 to 0.80 mass %; and a scale layer deposited on the surface of the base metal portion, wherein the Si average concentration in the interface portion of the scale with the base metal portion is not less than 2.0 times the Si content of the base metal portion.

2. The steel wire rod according to claim 1, wherein the Si concentrated area in which the Si concentration is not less than 2.0 times the Si content of the base metal portion in the interface portion of the scale layer occupies not less than 60 area %.

3. The steel wire rod according to claim 1, wherein the Si content of the base metal portion is not less than 0.1 mass %.

4. The steel wire rod according to claim 1, wherein the Si content of the base metal portion is not more than 0.6 mass %.

5. The steel wire rod according to claim 1, further comprising, not less than one selected from the group consisting of Mn: 0.01 to 2.0 mass %, Cr: 0 to 2.0 mass %, Mo: 0 to 0.6 mass %, Cu: 0 to 2.0 mass %, Ni: 0 to 4.0 mass %, Ti: 0 to 0.1 mass %, Al: 0.001 to 0.10 mass %, N: 0 to 0.03 mass %, V: 0 to 0.40 mass %, Nb: 0 to 0.15 mass %, and B: 0 to 0.005 mass %.

6. The steel wire rod according to claim 1, wherein the Si concentrated area in which the Si concentration is not less than 2.0 times the Si content of the base metal portion in the interface portion of the scale layer occupies not less than 80 area %.

7. A steel wire rod excellent in mechanical descalability, characterized by being manufactured by:

hot rolling a steel containing C: not more than 1.1 mass % and Si: 0.05 to 0.80 mass % at a rolling ending temperature of 1000 to 1100° C.;

after completion of the hot rolling step, cooling the steel down to a coiling starting temperature of 950 to 800° C. at a first cooling rate of less than 50° C./s;

cooling the steel in an oxygen supply atmosphere from the coiling starting temperature to 700° C. at a second cooling rate of not less than 3° C./s and not more than the critical cooling rate defined by the following equation (1):

$$\text{Critical cooling rate } (^\circ\text{ C./}s) = 22 + 11 \times [\text{Si}] - 8.5 \times \log(D) \quad (1)$$

(where [Si] denotes the Si content (mass %) of the steel, and D denotes the wire diameter (mm).); and further cooling the steel from 700 to 500° C. at a third cooling rate of not more than 2.5° C./s.

8. The steel wire rod according to claim 7, wherein the first cooling rate is not more than 45° C./s.

9. A method for manufacturing a steel wire rod excellent in mechanical descalability, comprising the steps of:

hot rolling a steel containing C: not more than 1.1 mass % and Si: 0.05 to 0.80 mass % at a rolling ending temperature of 1000 to 1100° C.;

after completion of the hot rolling step, cooling the steel down to a coiling starting temperature of 950 to 800° C. at a first cooling rate of less than 50° C./s;

cooling the steel in an oxygen supply atmosphere from the coiling starting temperature to 700° C. at a second cooling rate of not less than 3° C./s and not more than the critical cooling rate defined by the following equation (1):

$$\text{Critical cooling rate } (^\circ\text{ C./}s) = 22 + 11 \times [\text{Si}] - 8.5 \times \log(D) \quad (1)$$

(where [Si] denotes the Si content (mass %) of the steel, and D denotes the wire diameter (mm).); and further cooling the steel from 700 to 500° C. at a third cooling rate of not more than 2.5° C./s.

10. The method for manufacturing a steel wire rod according to claim 9, wherein the first cooling rate is not more than 45° C./s.

* * * * *